United States Patent [19]

Kroll

[11] Patent Number: 5,062,810

[45] Date of Patent: Nov. 5, 1991

[54] PLUG INSERT FOR A METAL TUBE HOUSING

[75] Inventor: Peter Kroll, Neckartailfingen, Fed. Rep. of Germany

[73] Assignee: Gebhard Balluff Fabrik feinmechanischer Erzeugnisse GmbH & Co., Fed. Rep. of Germany

[21] Appl. No.: 573,901

[22] Filed: Aug. 27, 1990

[30] Foreign Application Priority Data

Aug. 31, 1989 [DE] Fed. Rep. of Germany ..... 3928791

[51] Int. Cl.[5] ..... H01R 13/40

[52] U.S. Cl. ..... 439/589; 439/598; 439/705; 439/901; 439/903

[58] Field of Search ..... 439/589, 598, 603, 901, 439/903, 910, 271, 272, 705

[56] References Cited

U.S. PATENT DOCUMENTS

| | | | |
|---|---|---|---|
| 1,086,338 | 2/1914 | Sherman | 439/705 |
| 1,281,907 | 10/1918 | Burton | 439/705 |
| 3,034,092 | 5/1962 | Majewski | 439/903 |
| 4,659,164 | 4/1987 | Reuss | 439/901 |

FOREIGN PATENT DOCUMENTS

| | | | |
|---|---|---|---|
| 0364827 | 11/1962 | Canada | 439/598 |

*Primary Examiner*—Paula A. Bradley

*Attorney, Agent, or Firm*—Barry R. Lipsitz

[57] ABSTRACT

In order to improve a plug insert for a metal tube housing comprising a contact carrier with plug pins protruding from a first side thereof and solder terminals from a second side thereof opposite the first side, and a protective sleeve insertable in the metal tube so as to surround the contact carrier, with the protective sleeve extending with its front side from the first side of the contact carrier in a first direction parallel to the plug pins at least as far as one end thereof and forming in a second direction opposite the first direction a protective collar protruding beyond the second side of the plug element, such that it is also usable for high insulation voltages, in particular insulation voltages of 250 V and more, it is proposed that the protective sleeve and the contact carrier be two parts which can be put together, that the protective sleeve have a receiving means for insertion and fixing of the contact carrier therein, and that the protective collar protrude in the second direction beyond the solder terminals when the contact carrier is inserted in the protective sleeve.

13 Claims, 1 Drawing Sheet

PLUG INSERT FOR A METAL TUBE HOUSING

Figure 1:
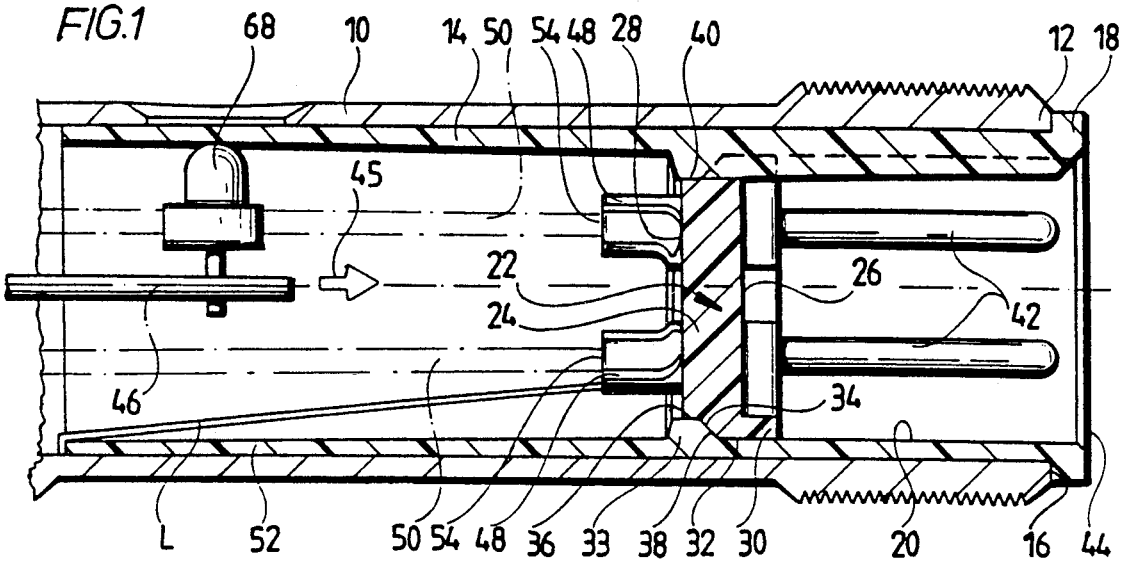

The invention relates to a plug insert for a metal tube housing comprising a contact carrier with plug pins protruding from a first side thereof and solder terminals from a second side thereof opposite the first side, and a protective sleeve insertable in the metal tube so as to surround the contact carrier. The protective sleeve extends with its front side from the first side of the contact carrier in a first direction parallel to the plug pins and forms in a second direction opposite the first direction a protective collar protruding beyond the second side of the contact carrier.

A plug insert of this kind is known from the prior art. Herein, the contact carrier and the protective sleeve are of one-piece design and the protective collar extends in the second direction over the same distance as the solder terminals so that cables can still be soldered to these solder terminals.

Such plug inserts are intended, above all, for metal tube housings with an inside diameter of less than 12 mm and, therefore, owing to the narrowness of the plug insert according to the prior art, the protective collar may only extend as far as the end of the solder terminals in order that cables can still be soldered to these solder terminals.

Hence these plug inserts have the disadvantage, owing to the narrowness, of being usable for low voltages only, as the clearance from the solder terminal to the metal tube housing required for higher voltages is not achievable.

The object underlying the invention is, therefore, to so improve a plug insert of the generic kind, particularly for metal tube housings with small diameters, preferably for metal tube housings with an inside diameter of 12 mm or less, that it is also usable for high insulation voltages, in particular insulation voltages of 250 V and more.

This object is accomplished in accordance with the invention with a plug insert of the kind described at the beginning by the protective sleeve and the contact carrier being two parts which can be put together, by the protective sleeve having a receiving means for insertion and fixing of the contact carrier therein, and by the protective collar protruding in the second direction beyond the solder terminals when the contact carrier is inserted in the protective sleeve.

The advantage of the inventive solution is to be seen, above all, in the fact that in spite of a protective collar protruding far beyond the solder terminals in the second direction, there is still the possibility of soldering a cable to the solder terminals in a simple manner as this can be carried out before the contact carrier is inserted in the protective sleeve.

It is favourable in the inventive solution for the protective sleeve to extend in the first direction at least as far as one end of the plug pins. It is even more favourable to have the sleeve extending beyond these pins. The protective collar may, in principle, extend to any extent beyond the solder terminals. A solution wherein the protective collar protrudes beyond the solder terminals by at least 5 mm is particularly preferred.

In principle, the contact carrier can be insertable in the protective sleeve from both sides. It is, however, particularly advantageous for the contact carrier to be insertable in the protective sleeve from the front side.

Very different solutions are also conceivable for the means for receiving the contact carrier. It has proven particularly expedient for the protective sleeve to have an annular collar protruding from an inner side thereof as receiving means.

For defined fixing of the contact carrier on the annular collar, provision is expediently made for the contact carrier to have an annular recess which faces the protective sleeve and is open towards the second side.

The contact carrier can be fixed in a particularly well defined manner if the collar has a conical seat. It is, therefore, also advantageous for the recess to have a conical, annular wall corresponding to the seat.

With regard to the arrangement of the solder terminals on the contact carrier, it has proven particularly advantageous for the solder terminals to be freely accessible from the second side of the contact carrier in the second direction and perpendicularly thereto.

In this case, the contact carrier is preferably of such design that it extends in the second direction as far as a surface defined by the second side, i.e., has no areas protruding beyond the second side.

In all of the embodiments described hereinabove, it is particularly advantageous and desirable for the protective collar to fully line the metal tube housing throughout its entire extent in the second direction.

In accordance with the invention, the protective sleeve and the contact carrier are made of a non-conductive material, preferably of a plastics material.

Figure 2:
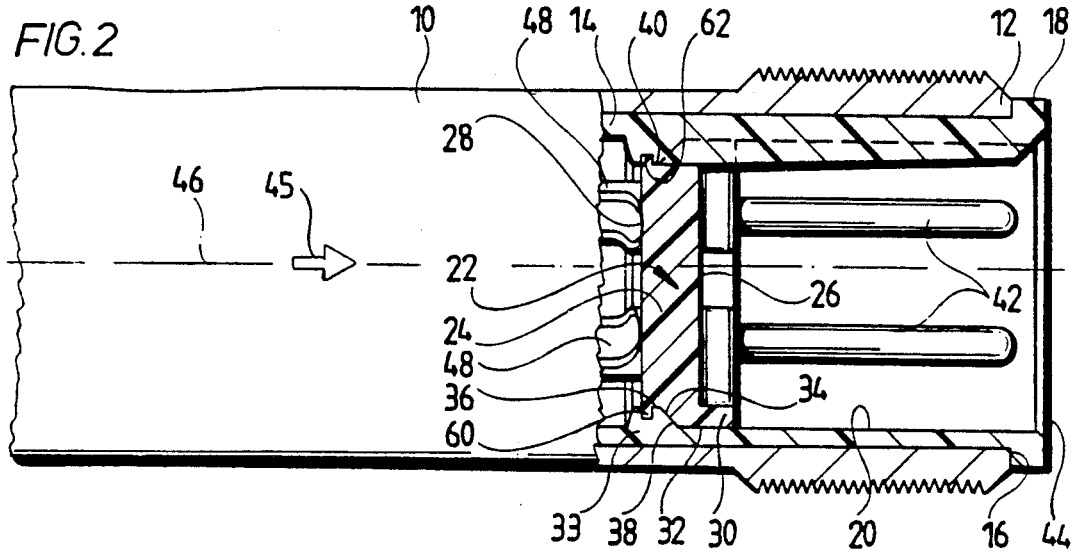
Figure 3:
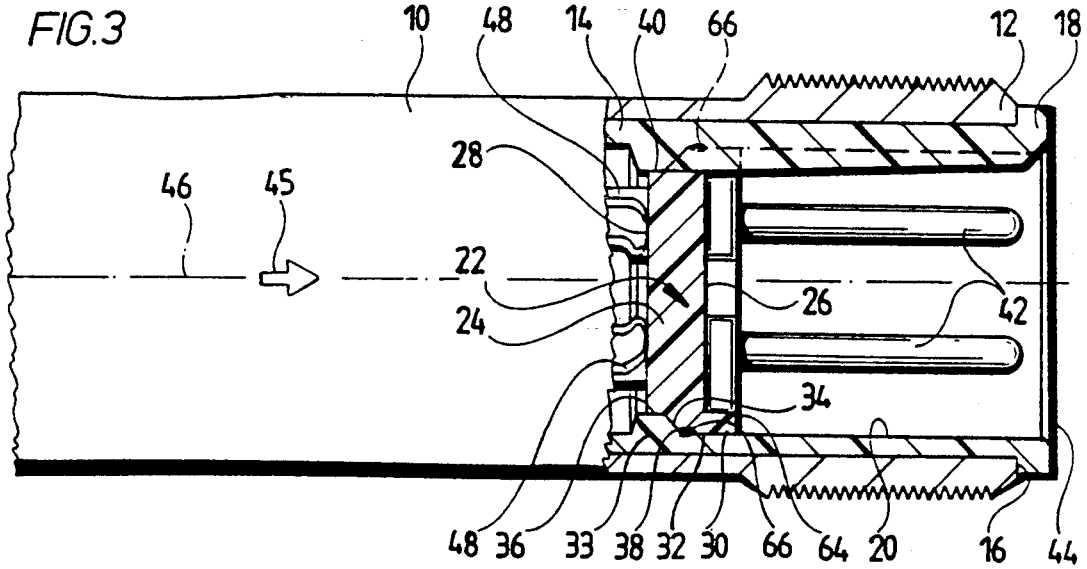

Further advantages of the invention are to be found in the following description and the appended drawings of several embodiments. The drawings show:

FIG. 1 a longitudinal section through a first embodiment of an inventive plug insert in the assembled state;

FIG. 2 a longitudinal section similar to FIG. 1 through a second embodiment;

FIG. 3 a longitudinal section similar to FIG. 1 through a third embodiment.

An embodiment of an inventive plug insert for a cylindrical, metal tube housing 10 comprises a cylindrical protective sleeve 14 insertable in the metal tube housing 10 from a front end 12 thereof. The protective sleeve 14 comprises a front collar 18 which, in the inserted state, rests on an end face 16 arranged at the front end 12. This collar 18 preferably has an outside diameter which is identical with the metal tube housing 10. The position of the protective sleeve 14 in the inserted state shown in FIG. 1 is defined by this collar 18.

The protective sleeve 14 is shaped in the fashion of a cylinder jacket and has a cylindrical inside wall surface 20.

A contact carrier designated in its entirety 22 is insertable in this protective sleeve 14 from the side of the collar 18. The contact carrier 22 comprises a contact carrier plate 24 which in the state inserted in the protective sleeve 14 has a first side 26 facing the collar 18 and a second side 28 facing away from the collar 18. A cylindrical extension 30 protrudes beyond the first side 26 of the contact carrier plate 24. The extension 30 is integrally formed on the contact carrier plate 24 and forms together with it a cylindrical outside surface 32 with which the contact carrier 22 is guided on the inside wall surface 20 of the protective sleeve 14.

For defined fixing of the contact carrier 22, the protective sleeve 14 has an annular collar 33 protruding inwardly from the inside wall surface 20. On its side facing the collar 18, the annular collar 33 has an annular surface 34 sloping conically in the direction towards the inside wall surface 20 and, in addition, an inside surface 36 extending parallel to the inside wall surface 20.

The contact carrier plate 24 is shaped accordingly. Adjoining the cylindrical outside surface 32, it has an annular surface 38 which extends conically radially inwardly and can be brought to rest against the annular surface 34. Adjoining the annular surface 38, the contact carrier plate 24 has an outside surface 40 which keeps the contact carrier plate 24 centered on the inside surface 36.

Hence the contact carrier 22 can be inserted into the protective sleeve 14 from the collar 18 until the annular surface 34 and the annular surface 38 come to rest against one another.

The position of the contact carrier 22 is determined by plug pins 42 extending away from the first side 26 of the contact carrier plate 24. These should extend as far as the collar 18 and preferably terminate immediately before a front side 44 of the protective sleeve 14. The plug pins 42 run parallel to a longitudinal axis 46 of the metal tube housing 10 and the protective sleeve 14 in a first direction 45, while the solder terminals 48 run in a second direction opposite the first direction 45 parallel to the longitudinal axis 46. A protective collar 52 covering the entire inside wall surface 20 also extends in this second direction.

Solder terminals 48 associated with the plug pins 42 furthermore rise from the second side 28 of the contact carrier plate 24. Connecting cables 50 shown merely in dot-and-dash lines and running inside the metal tube housing can be soldered to the solder terminals 48.

The protective collar 52 is formed by the section 52 of the protective sleeve 14 which extends away from the second side 28 in the second direction and is to prevent voltage sparkovers from the solder terminals 48 to the metal tube housing 10. The protective collar 52 should keep a clearance L extending from a rear end 54 of the solder terminals 48 to the metal tube housing 10 as large as possible.

Provision is preferably made for the clearance L to be more than 5 mm. Hence the protective collar 52 extends by at least 5 mm from the rear end 54 of the solder terminals 48 away from the second side 28 in the direction of the longitudinal axis 46.

To assemble the inventive plug insert, the cables 50 are first soldered to the solder terminals 48 before the contact carrier 22 is inserted in the protective sleeve 14, and the contact carrier 22 is then inserted in the protective sleeve 14 from the collar 18 and fixed on the annular collar 32, as shown in FIG. 1, preferably by press fit.

Alternatively, as shown in FIG. 2, a snap-in connection may be provided. The contact carrier plate is then provided, preferably at the level of the second side 28, with radially outwardly protruding claws 60 which engage corresponding recesses 62 in the inside surface 36 of the annular collar 32 and hence prevent movement of the contact carrier plate 24 in the direction of the collar 18.

In a third embodiment, shown in FIG. 3, the contact carrier 22 is welded to the protective sleeve 14 in the area of contact between the inside wall surface 20 of the protective sleeve 14 and the outside surface 32 of the cylindrical extension 30 facing the inside wall surface 20. The resulting weld 66 preferably extends circumferentially along the inside wall surface 20.

Above all, when display elements 68 are provided in the protective sleeve 14—as shown in FIG. 1—the protective sleeve 14 is made of a translucent or transparent material.

The present disclosure relates to the subject matter disclosed in German application No. P 39 28 791.2 of Aug. 31, 1989, the entire specification of which is incorporated herein by reference.

What is claimed is:

1. A plug inset for a metal tube housing comprising:

a contact carrier with plug pins protruding from a first side thereof and solder terminals protruding from a second side thereof opposite said first side; and a protective sleeve adapted to be inserted into said metal tube housing for holding said contact carrier;

said protective sleeve having:

a receptacle adapted to receive and retain said contact carrier to form a unitary structure for mounting said plug pins and solder terminals within said metal tube housing, said receptacle containing means therein for limiting the travel of the contact carrier into the receptacle, a front extension adapted to project from the first die of said contact carrier in a first direction parallel to said plug pins when the contact carrier is retained in said receptacle, and a rear extension adapted to project from the second side of said contact carrier in a second direction opposite said first direction and beyond said solder terminals when the contact carrier is retained in said receptacle.

2. Plug insert as defined in claim 1, characterized in that said rear extension protrudes beyond said solder terminals by at least 5 mm.

3. Plug insert as defined in claim 1, characterized in that said contact carrier is insertable in said protective sleeve from a front face of said front extension.

4. Plug insert as defined in claim 1, characterized in that said solder terminals are freely accessible from said second side of said contact carrier in said second direction and perpendicularly thereto.

5. Plug insert as defined in claim 1, characterized in that said contact carrier extends in said second direction as far as a surface defined by said second side.

6. Plug insert as defined in claim 1, characterized in that said protective sleeve is made of translucent or transparent material.

a receptacle adapted to receive and retain said contact carrier to form a unitary structure for mounting said plug pins and solder terminals within said metal tube housing, said receptacle containing means therein for limiting the travel of the contact carrier into the receptacle, a front extension adapted to project from the first side of said contact carrier in a first direction parallel to said plug pins when the contact carrier is retained in said receptacle, and a rear extension adapted to project from the second side of said contact carrier in a second direction opposite said first direction and beyond said solder terminals when the contact carrier is retained in said receptacle.

7. A plug insert as defined in claim 1 wherein said contact carrier is retained in said receptacle by a press fit.

8. A plug insert as defined in claim 1 wherein said contact carrier is retained by said limiting means in said receptacle by a snap fit.

9. A plug insert as defined in claim 1 wherein said contact carrier is welded in said receptacle.

10. Plug insert as defined in claim 1, characterized in that said receptacle limiting means comprise an annular collar protruding from an inner side of said receptacle to receive said contact carrier.

11. Plug insert as defined in claim 10, characterized in that said annular collar has a conical seat.

12. Plug insert as defined in claim 10, characterized in that said contact carrier has an annular recess for mating with said annular collar.

13. Plug insert as defined in claim 12, characterized in that said annular collar has a conical seat and said annular recess has a conical, annular wall corresponding to said conical seat.

* * * * *

UNITED STATES PATENT AND TRADEMARK OFFICE

CERTIFICATE OF CORRECTION

PATENT NO. : 5,062,810

DATED : November 5, 1991

INVENTOR(S) : Kroll

It is certified that error appears in the above-identified patent and that said Letters Patent is hereby corrected as shown below:

In claim 1, at column 4, line 22, "first die" should read -- first side -- .

In column 4, delete the text in lines 47 to 61 which appears between claims 6 and 7.

Signed and Sealed this

Ninth Day of March, 1993

*Attest:*

STEPHEN G. KUNIN

*Attesting Officer*

*Acting Commissioner of Patents and Trademarks*